US005190149A

United States Patent [19]

Krause

[11] Patent Number: 5,190,149

[45] Date of Patent: Mar. 2, 1993

[54] SIDE-PIVOTING FRANGIBLE OPENING FOR CONTAINER END WALL

[76] Inventor: Arthur A. Krause, 20642 Skouras Dr., Canoga Park, Calif. 91306

[21] Appl. No.: 858,651

[22] Filed: Mar. 27, 1992

[51] Int. Cl.[5] ..... B65D 17/34

[52] U.S. Cl. ..... 220/269

[58] Field of Search ..... 220/269, 270, 271, 272, 220/273, 276

[56] References Cited

U.S. PATENT DOCUMENTS

| | | | |
|---|---|---|---|
| 3,216,609 | 11/1965 | Bogert | 220/269 |
| 3,294,275 | 12/1966 | Mileto et al. | 220/270 |
| 3,967,753 | 7/1976 | Cudzik | 220/269 |
| 3,970,212 | 7/1976 | Brown | 220/269 |
| 4,055,275 | 10/1977 | Gontar | 220/269 |
| 4,125,203 | 11/1978 | Sovari et al. | 220/258 |
| 4,301,940 | 11/1981 | Cvacho | 220/269 |
| 4,576,304 | 3/1986 | Henning | 220/269 |
| 4,605,141 | 8/1986 | Won | 220/269 |
| 4,705,186 | 11/1987 | Barrash | 220/269 |
| 4,848,623 | 7/1989 | Saunders et al. | 220/273 |

*Primary Examiner*—Allan N. Shoap
*Assistant Examiner*—Nova Stucker
*Attorney, Agent, or Firm*—Dennis H. Lambert

[57] ABSTRACT

A tear tab closure for forming an opening in a container end wall, in which the tear tab remains external of the container and captive thereon when it is opened, and further wherein the tear tab is constructed so that there are no recesses for collecting foreign matter. The tear tab is separable from the container end wall along a frangible score line to form the opening, and an actuating tab is attached to the end wall adjacent the tear tab to engage the tear tab and lift it relative to the end wall to fracture the score line. The actuating tab includes a first portion that engages the end wall adjacent the score line to initiate fracture of the score line and move the end wall relative to the tear tab so that an edge portion of the tear tab is exposed above the plane of the adjacent end wall, and a second portion that engages beneath the edge of the tear tab to progressively fracture the score line and fold the tear tab back away from the end wall as the actuating tab is pivoted about its point of attachment with the container end wall.

10 Claims, 5 Drawing Sheets

FIG. 12
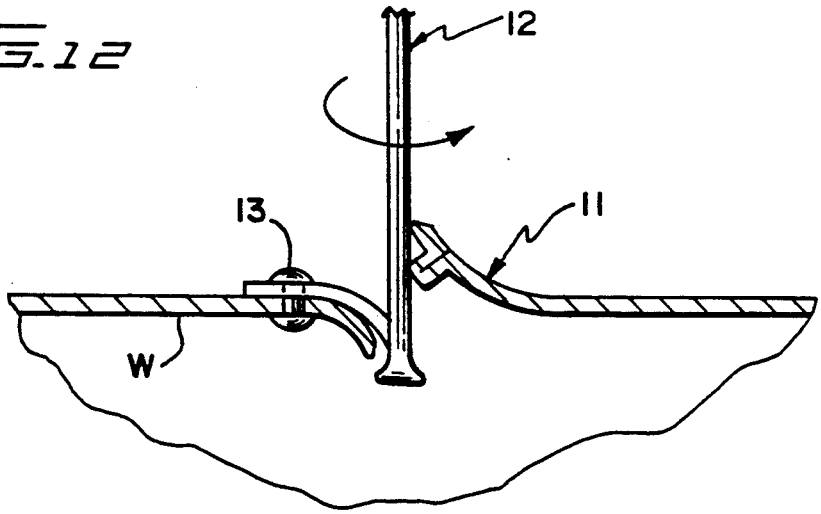
FIG. 13
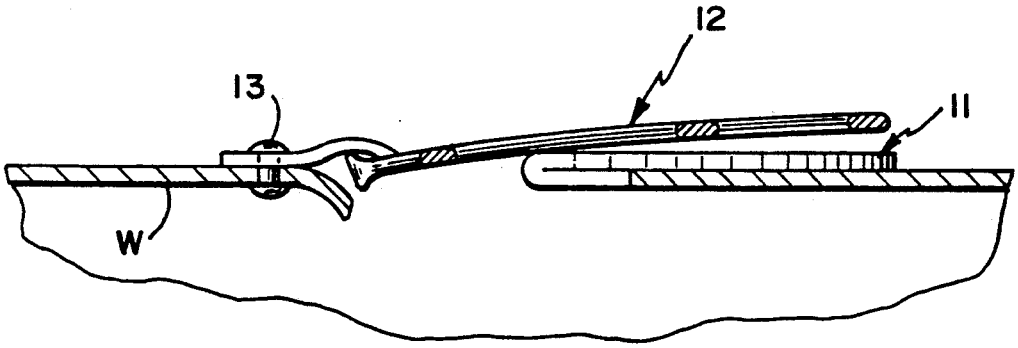
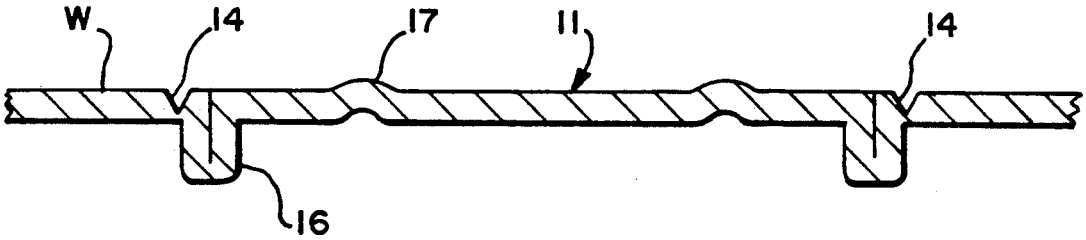
FIG. 14

SIDE-PIVOTING FRANGIBLE OPENING FOR CONTAINER END WALL

FIELD OF THE INVENTION

This invention relates to means for forming an opening in the end of a container, especially a beverage container. More particularly, the invention relates to a tear tab closure that is separable along a score line from the container end to form an opening.

BACKGROUND OF THE INVENTION

The advent of metal and metal alloy containers for beverages, food and other goods led to the development of a variety of means for closing and sealing such containers. Many such closures include permanently affixed container ends which are cut away with separate hand tools. This type of closure is in common use with cans for holding a variety of food products, which are typically stored in a kitchen area and suitable hand tools for opening the container are thus readily accessible.

Beverage containers, on the other hand, have more commonly been developed with convenient, integrally attached tabs that are torn away to form an opening in the container. For example, many containers of non-carbonated beverages, such as fruit juice and the like, have an opening in an end wall that is closed by a strip of removable tape. This type of closure is not entirely satisfactory, however, because of the less sturdy nature of such closures, and the susceptibility of them to tampering.

Carbonated beverages generally require more secure closures, and have evolved with a variety of so-called "pop-top" or "pull-tab" devices for forming an opening in an end wall of the container. Early devices included removable sections or tabs joined to the container end wall along a frangible score line, and a pull ring attached to the removable tab so that the tab could be pulled from the container end, separating along the score line to form an opening. The removed tab and the attached pull ring were then discarded. This approach eventually proved unsatisfactory, however, because of the ecological damage created by the discarded tabs and pull rings.

To alleviate the environmental harm produced by such removable pull tabs, closures were developed that remained attached to the container after being opened. These closures also comprise a frangible section of the container end wall, joined to the end wall along a score line, and include an actuating ring associated with the frangible section. However, rather than being completely removed from the container end wall and discarded, the frangible section remains attached to or captive on the container.

The most commonly used closure of the latter type is pushed into the container by the actuating ring. While this solves the problem related to environmental damage that was caused by discarded pull tabs, it gives rise to new problems. For instance, the container end wall and frangible section sometimes become contaminated with dirt or other foreign material. Consequently, when the section is displaced into the interior of the container to form an opening, the contents of the container are subject to contamination by the inwardly displaced contaminated frangible section.

To solve the latter problem, some containers are provided with frangible sections that are separated along a score line from an end wall of the container to form an opening, but instead of being pushed into the container, are folded back externally of the container. While this approach solves the problems related to contamination of the contents of the container, it raises the possibility of injury to a person handling the container because of the exposed sharp edge of the separated tab. Moreover, it is possible that the pull ring and tear tab will not be folded down fully against the container after the tear tab is separated from the end wall along the score line. The protruding pull ring and/or tear tab could then cause injury to the user. This potential difficulty is especially acute in those instances when children open the container.

The problem of exposed sharp edges has been solved in some prior art devices by placing folds in the material of the end wall adjacent the severed edge, or by providing a layer of protective material over the severed edge.

However, applicant is not aware of any prior art device of this type, i.e., a non-invasive pull tab closure that remains attached to the container, in which the structure and method of opening is such that it is assured that the pull ring and tear tab will be in an unobtrusive position when the tear tab is separated along the score line.

Accordingly, there is need for a simple and inexpensive closure means for containers, especially of the tear tab variety, which is captive on the container and thereby does not lead to environmental contamination by discarded tabs and removable sections, but which also does not enter the container and potentially contaminate the contents of the container, or expose sharp edges which may injure the user, and further, which is constructed such that the pull ring and tear tab will be in an unobtrusive position when fully opened.

SUMMARY OF THE INVENTION

The present invention provides a simple and inexpensive closure means for containers, especially of the tear tab variety, which is captive on the container and thereby does not lead to environmental contamination by discarded tabs and removable sections, but which also does not enter the container and potentially contaminate the contents of the container, or expose sharp edges which may injure the user, and further, in which the tear tab is opened by a pivoted key or actuating tab that engages and folds the tear tab with a sweeping motion so that the tear tab and key are in an unobtrusive position when fully opened. The structure and manner of operation of the pivoted key and tear tab of the invention are such that the key may be moved in a continuous, essentially unidirectional motion from fully closed to fully open positions.

The tear tab closure of the invention is joined to the container end wall along a frangible score line that is interrupted near one end of the tab to form a hinge, and the key or actuating tab is attached to the container end wall adjacent the tear tab for fracturing the score line and folding the tear tab back and to one side in a "sweeping" motion to form an opening in the end wall. The structure and operation of the tear tab and key are such that they lie flat against the container end wall when the tab is fully opened, thus reducing or eliminating the risk of injury to the user from a partially opened tear tab.

The pivoted key is attached to the end wall of the container by a riveted or other suitable pivoted connection adjacent to the tear tab, and includes a protruding nose portion that lies near the score line in a position to engage the end wall and initiate fracturing of the score line by depressing the material of the end wall relative to the material of the tear tab. A heel on the key then engages under the edge of the tear tab to peel or fold the tear tab back away from the end wall when the key is pivoted or swept to one side around the pivoted connection. This opening movement may be effected in one continuous sweep, concluding with the tear tab and key lying flat against the end wall in an unobtrusive position.

A fold is preferably formed in the material of the end wall adjacent the score line, as described in detail in applicant's copending application Ser. No. 07/701,923, to form a barrier or shield to the exposed edge of the closure or tear tab after it is separated along the score line, thereby preventing injury to the user which might otherwise occur because of an exposed, sharpened edge.

The tear tab closure and fold of the invention are constructed so that a minimum amount of dirt or other foreign matter will become trapped on or adjacent the closure, thereby maintaining a cleaner environment on and around the closure and associated opening.

Further, the structure and manner of operation of the key are such that great leverage is obtained to initiate tearing of the score line, and to continue separation of the closure tab along the score line as the key is swept or pivoted into its opened position.

BRIEF DESCRIPTION OF THE DRAWINGS

The foregoing, as well as objects and advantages of the invention will become apparent from the following detailed description when considered in conjunction with the accompanying drawings, in which like reference characters designate like parts throughout the several views, and wherein:

FIG. 12 is a fragmentary, enlarged sectional view taken along line 12—12 in FIG. 6;

FIG. 13 is a fragmentary, enlarged sectional view taken along line 13—13 in FIG. 9; and FIG. 14 is a greatly enlarged fragmentary sectional view taken along line 14—14 in FIG. 1.

DETAILED DESCRIPTION OF THE PREFERRED EMBODIMENTS

With particular reference to the drawings, a container end wall closure in accordance with the invention is indicated generally at 10 in FIGS. 1-12.

The closure 10 comprises a tear tab 11 formed integrally with the container end wall W, and an actuating tab or pivoted key opener 12 joined to the end wall W via a rivet 13.

Figure 1:
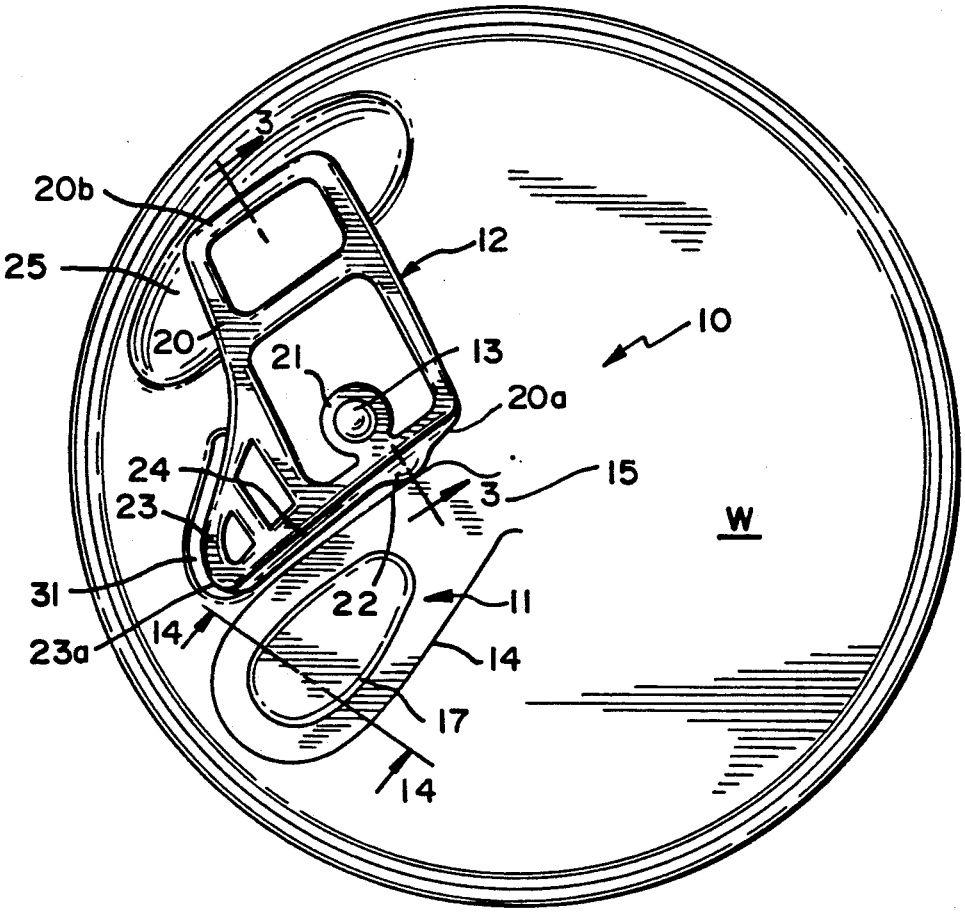
FIG. 1 is a top plan view of a captive tear tab and pivoted key opener according to the invention, shown in place in fully closed position on a container end.
Figure 2:
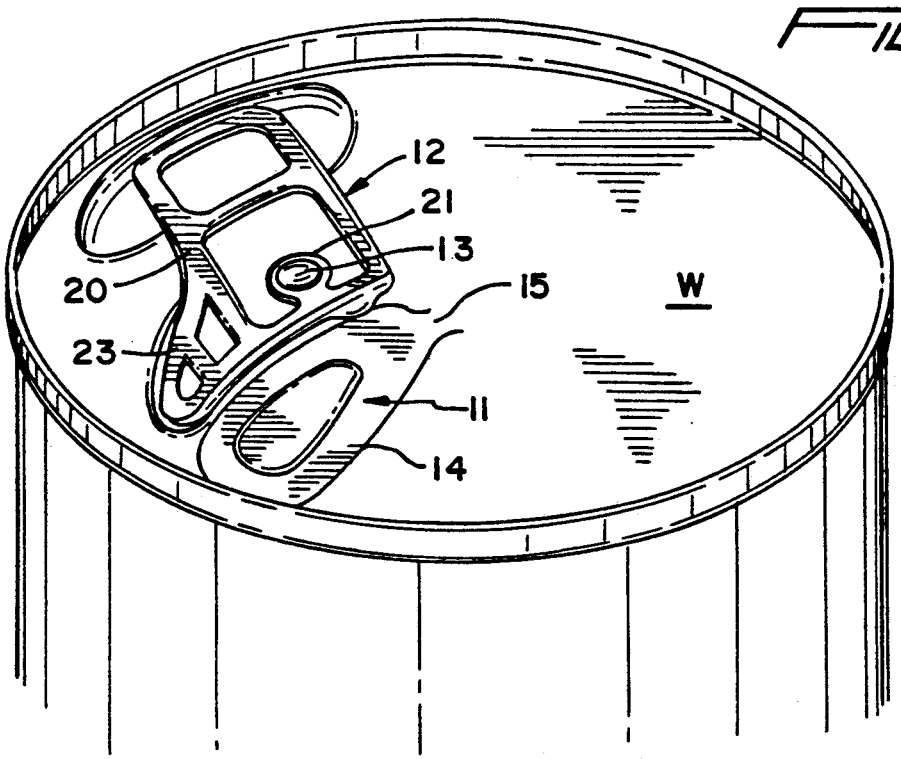
FIG. 2 is a top perspective view of the structure of FIG. 1, shown in fully closed position.

The tear tab 11 is delineated by a frangible score line 14 formed in the material of the end wall, as seen best in FIG. 1. This score line is interrupted at a base end of the tear tab to form a hinged connection 15 about which the tear tab is folded to its open position. Preferably, and as more fully described in copending application Ser. No. 07/701,923, a vertical fold 16 may be formed in the material of the tear tab adjacent the score line to provide a safety shield against the sharp edge that results from separation of the tear tab from the end wall. Further, a raised reinforcing structure or ring 17 may be formed in the material of the tear tab to strengthen it, if desired.

The actuating tab 12 is generally boot-shaped in plan view, and comprises a formed section of generally rectangular shape defining an actuating lever 20 that is attached at one end **20*a* to the container end wall by the rivet 13, and which extends generally radially on the end wall to near an outer edge thereof at its other end 20*b*. The rivet 13 extends through a short tab 21 on said one end, and as seen best in FIGS. 3 and 12, a downwardly formed nose 22 on said one end extends into proximity with the end wall closely adjacent the score line to concentrate force when the lever is actuated to thereby initiate fracture of the score line. The actuating lever 20, riveted connection 13, and nose 22** are spaced relative to one another such that great leverage is exerted when the lever is actuated, whereby fracturing of the score line is easily accomplished.

The actuating tab or pivot key also includes a toe portion 23 that protrudes from one side of the lever 20 at its said one end **20*a*, and which lies alongside the score line and one side edge of the tear tab prior to actuation of the lever. As seen best in FIG. 1, this toe portion gradually tapers to a reduced width at its outer end 23*a*. Further, a heel 24** extends along the top surface of the lever and toe portion at the edge thereof adjacent the score line and tear tab, for a purpose described hereinafter.

Figure 3:
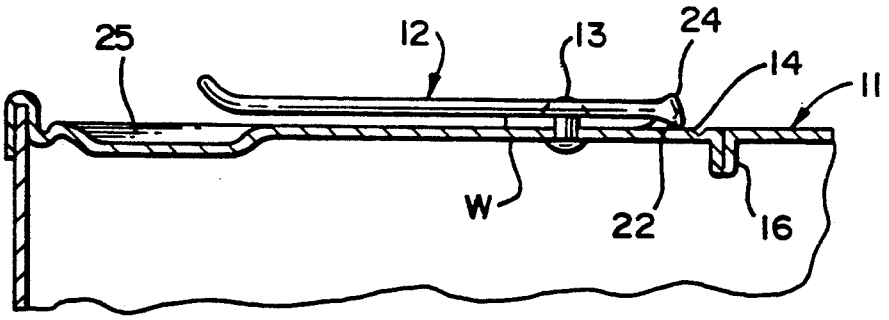
FIG. 3 is a fragmentary transverse sectional view of the pivoted key and a portion of the tear tab and container end wall, taken along line 3—3 in FIG. 1.

Upward lifting or actuation of the lever and initial fracturing of the score line are facilitated by giving the outer end **20*b* of the lever a slight upward deformation and/or by providing a shallow depression 25 in the end wall in the area underlying the outer end of the lever, as seen best in FIGS. 1 and 3. This enables the user to obtain a secure grip under the end of the lever. Further, and as noted previously, the rivet 13** is located relatively near the forward or riveted end of the tear tab, whereby maximum leverage is obtained.

Figure 4:
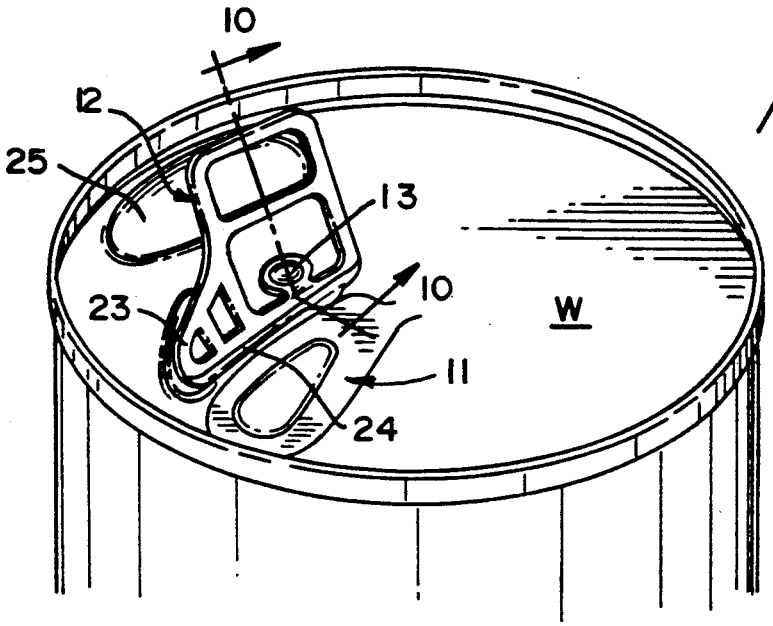
FIG. 4 is a top perspective view similar to FIG. 2, showing the key in an initial opening position for starting fracture of the score line.
Figure 5:
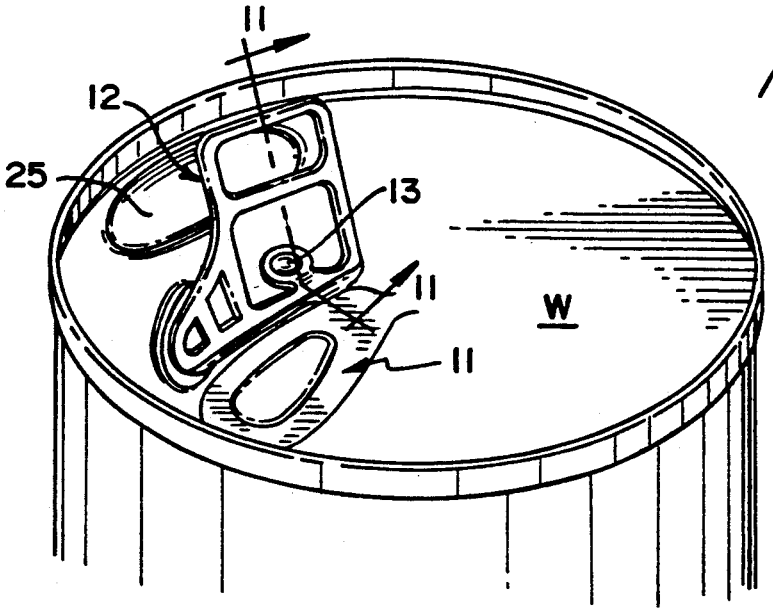
FIG. 5 is a top perspective view similar to FIG. 4, showing the key in an upright position just prior to beginning its sideward sweep to open the tear tab closure.
Figure 6:
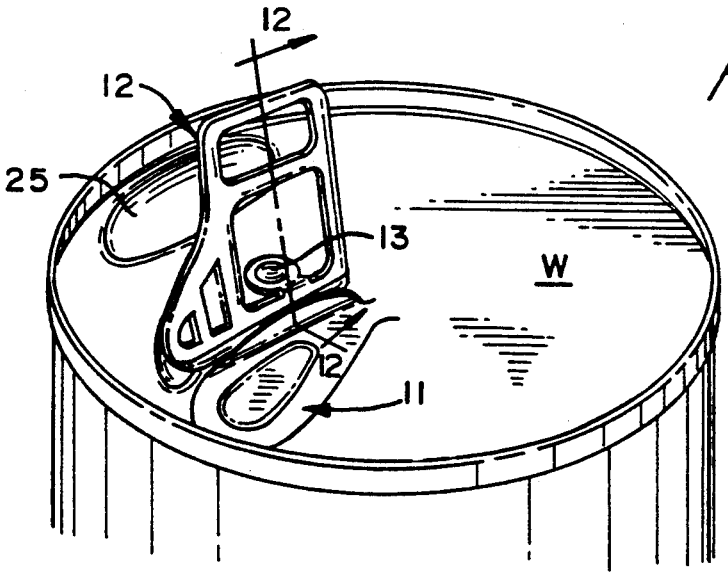
FIG. 6 is a top perspective view similar to FIG. 5, showing the relationship of the key and tear tab after an initial pivoted or sweeping movement of the key to open the tab.
Figure 7:
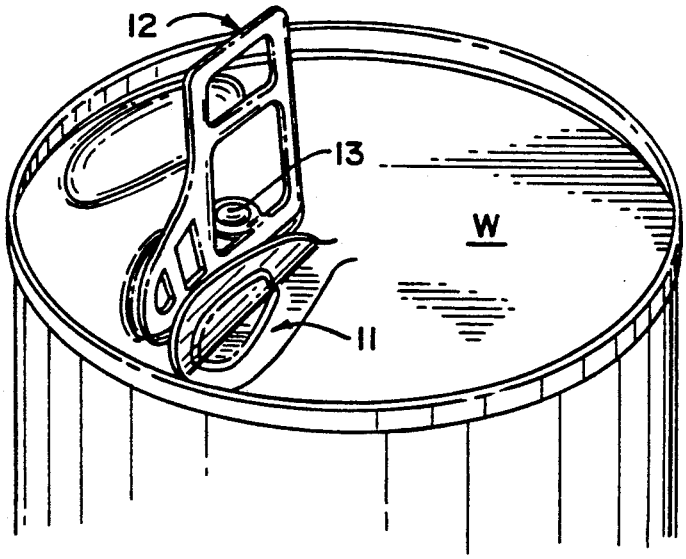
FIG. 7 is a top perspective view similar to FIG. 6, showing the key and tab in their relative positions when the closure is approximately half opened.
Figure 8:
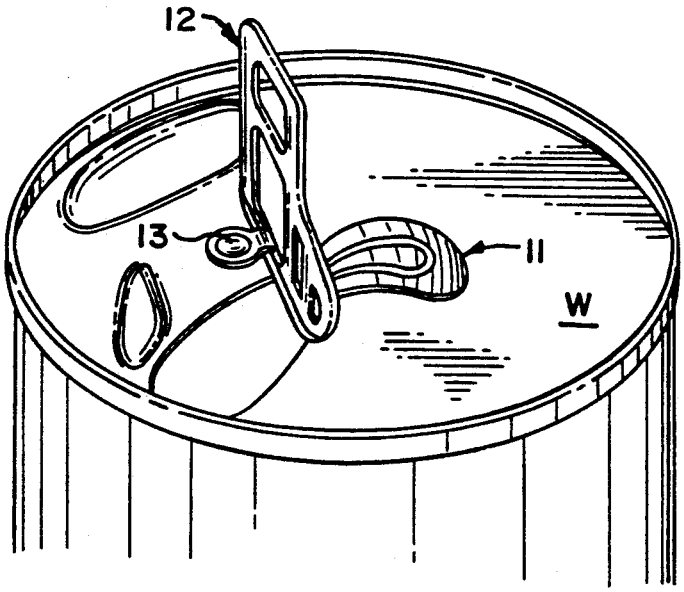
FIG. 8 is a top perspective view similar to FIG. 7, showing the key and closure in a nearly fully opened position.
Figure 9:
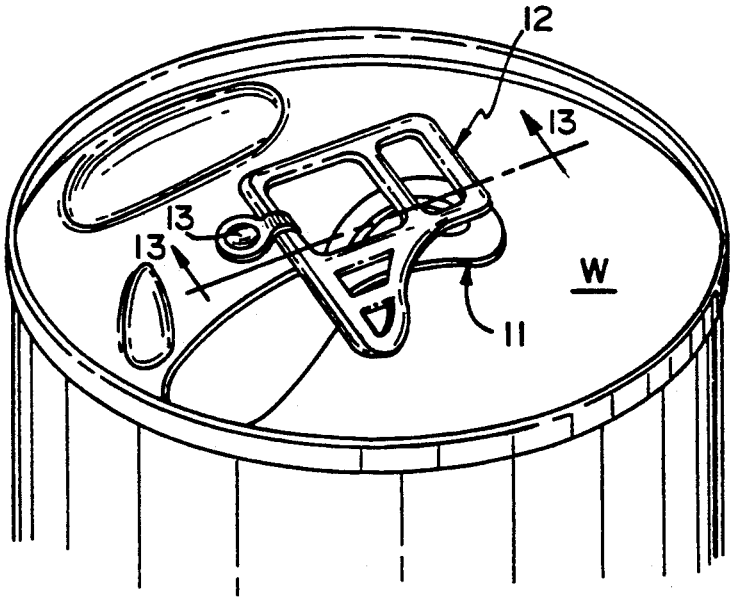
FIG. 9 is a top perspective view similar to FIG. 8, showing the relative positions of the parts when fully opened.
Figure 10:
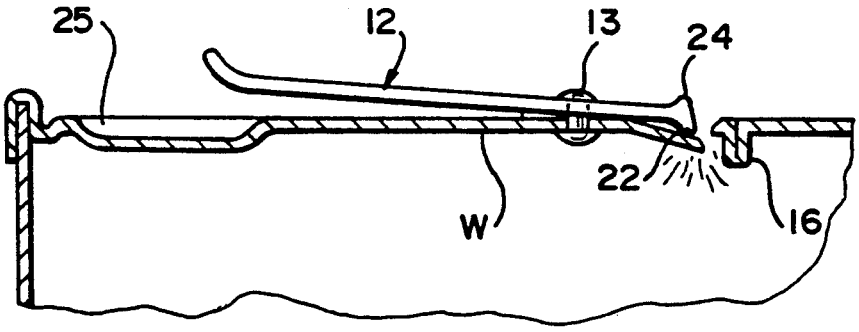
FIG. 10 is a fragmentary, enlarged sectional view taken along line 10—10 in FIG. 4.
Figure 11:
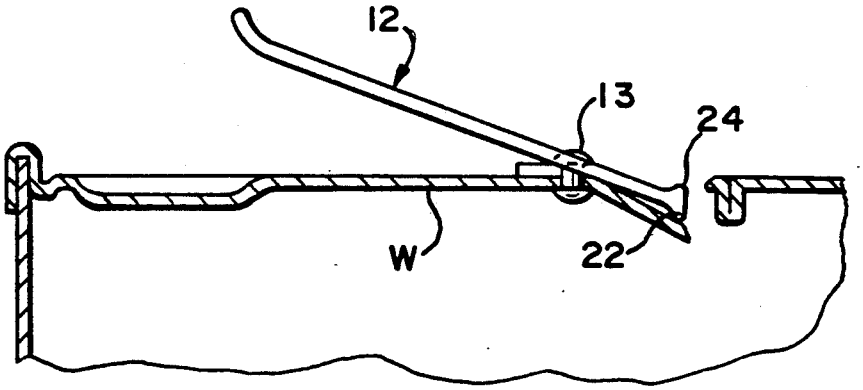
FIG. 11 is a fragmentary, enlarged sectional view taken along line 11—11 in FIG. 5.

Additionally, the fold 16 not only defines a shield for protecting the user from any sharpened portions of the severed edge of the tear tab, but also defines a reinforced structure at the perimeter of the tear tab, facilitating its separation from the container end wall along the score line. In other words, upward movement of the outer end of the lever 20, as depicted in FIGS. 4 and 5, presses the nose 22 downwardly against the end wall, moving a small portion of the end wall relatively to the tear tab and causing fracturing of the score line. At the same time, the edge portion of the pivot key 12 dips beneath the adjacent edge of the tear tab, and subsequent sweeping movement of the pivot key about the riveted connection causes the tear tab to progressively separate from the end wall along the score line as the tear tab is rolled or folded back away from the resulting opening 30 thus formed in the end wall.

To prevent inadvertent lateral displacement or pivoting of the actuating tab about the riveted connection 13, a shallow locating depression 31 may be formed in the end wall for reception of at least a part of the actuating tab. See FIG. 1.

The progressive opening movement of the pivot key and tear tab are somewhat schematically illustrated in FIGS. 4–13, where the function of the toe portion 23 and heel 24 can be clearly seen. Thus, and with particular reference to these figures, the nose 22 initiates fracturing of the score line, and the toe portion then sweeps around in an arc as the pivot key is pivoted about the riveted connection to progressively lift the tear tab and fold it back as the score line is progressively fractured from the point of initial separation to the opposite end adjacent the hinged area. Movement of the pivot key continues in one continuous motion until it lies flat against the fully opened tear tab, as shown in FIG. 13. It should be understood that it is also possible that it may not be necessary to swing the pivot key through an arc in order to open the tear tab, but the pivot key or actuating tab may be lifted upwardly to initiate fracturing of the score line and then simply continued in the direction indicated by the arrow in FIG. 1 until the tear tab and pivot key lie against the container end wall. In other words, a deliberate sweeping motion may not be necessary.

It should be noted that the fold 16 and tear tab are constructed such that the retention or accumulation of foreign material on the tear tab and/or container end is minimized, thereby minimizing the risk of contamination of the contents of the container upon opening of the tear tab. In other words, the tear tab of the invention does not include any recessed structure which would tend to trap such foreign matter. Instead, the container end wall and tear tab define relatively flat, smooth structures for reducing any tendency to trap foreign material. In this connection, the folds are shown in somewhat exaggerated form in the drawings, but it should be understood that the bight portion or fold 16 is essentially closed, with the material of the two vertical parts of the bight portion being disposed in contact with one another whereby foreign material cannot be trapped between the two vertical portions.

In one specific example of a tear tab closure constructed in accordance with the invention, the vertical fold 16 extends downwardly below the plane of the end wall W a distance of from about $\frac{1}{32}$ of an inch to about $\frac{1}{4}$ of an inch.

Further, the score line 14 is formed contiguous to the vertical fold, whereby there is no horizontally projecting portion remaining on the tear tab after it is separated from the container end wall W along the score line. This close placement of the score line to the vertical walls, and the shielding effect provided by the vertical fold, virtually eliminates the chance of inflicting a cut on the hand of the user by the severed edge of the tear tab.

The tear tab closure of the invention is captive on the container and does not break away for disposal and potential environmental contamination. Moreover, the tear tab closure of the invention does not enter or project into the container when it is opened, and therefore maintains a more sanitary environment for the contents of the container. Further, the unique construction of the tear tab of the invention makes it easy and safe to use, with the severed edge of the tear tab being shielded from contact with the skin of the user, and the unique sweeping motion of the pivot key requiring very little force to operate.

While the invention has been shown and described in detail, it is obvious that this invention is not to be considered as being limited to the exact form disclosed, and that changes in detail and construction may be made therein within the scope of the invention, without departing from the spirit thereof.

What is claimed is:

1. In a container closure of the type having a tear tab formed integrally in a container end wall and joined to the container end wall along a frangible score line for separation from the end wall to form an opening, and an actuating tab attached to the end wall at a point of attachment adjacent to the tear tab, said actuating tab being in a position to engage and remove the tear tab to form the opening, the improvement comprising:

said actuating tab being attached to the container end wall in a position adjacent to and separate from the tear tab, and including a nose portion that engages the end wall adjacent the score line to initiate fracture of the score line and move the end wall relative to the tear tab so that an edge portion of the tear tab is exposed above the plane of the adjacent end wall, and a heel portion that engages beneath the edge of the tear tab to progressively fracture the score line and fold the tear tab back away from the end wall as the actuating tab is pivoted about its point of attachment with the container end wall and pivoted into overlying relationship with the tear tab against the end wall when the tear tab is fully opened.

2. A closure as claimed in claim 1, wherein:

the actuating tab is pivotally connected to the end wall, and includes an actuating lever portion that extends laterally away from the tear tab and pivotal connection, said pivotal connection being at one end of the actuating lever, and a toe portion that extends laterally to the actuating lever portion in close proximity to the score line and tear tab, whereby lifting of the actuating lever about its pivoted connection and swinging movement of the actuating lever and toe portion through an arc from one side of the tear tab to another side thereof causes the actuating tab to engage under an exposed edge of the tear tab and progressively fold it back to form the opening in the container end wall.

3. A closure as claimed in claim 2, wherein:

the pivotal connection of the actuating tab to the container end wall comprises a rivet extended through the container end wall and through a short tab on said one end of the actuating lever.

4. A closure as claimed in claim 2, wherein:

said nose portion is short and projects from an undersurface of said one end of the actuating lever toward and into proximity with the container end wall closely adjacent the score line , concentrating force in a small area to facilitate initial fracturing of the score line when the actuating lever is lifted; and said heel portion is elongate, extending along an upper surface of the toe portion and said one end of the actuating lever at an edge thereof close to the score line.

5. A closure as claimed in claim 1, wherein:

said tear tab is reinforced to rigidify it and enable the actuating tab to push the container end wall downwardly relative to the tear tab.

6. A closure as claimed in claim 5, wherein:

the actuating tab is pivotally connected to the end wall, and includes an actuating lever portion that extends laterally away from the tear tab and pivotal connection, said pivotal connection being at one end of the actuating lever, and a toe portion that extends laterally to the actuating lever portion in close proximity to the score line and tear tab, whereby lifting of the actuating lever about its pivoted connection and swinging movement of the actuating lever and toe portion through an arc from one side of the tear tab to another side thereof causes the actuating tab to engage under an exposed edge of the tear tab and progressively fold it back to form the opening in the container end wall.

7. A closure as claimed in claim 6, wherein:

the pivotal connection of the actuating tab to the container end wall comprises a rivet extended through the container end wall and through a short tab on said one end of the actuating lever.

8. A closure as claimed in claim 7, wherein:

said nose portion is short and projects from an undersurface of said one end of the actuating lever toward and into proximity with the container end wall closely adjacent the score line, concentrating force in a small area to facilitate initial fracturing of the score line when the actuating lever is lifted; and said heel portion is elongate, extending along an upper surface of the toe portion and said one end of the actuating lever at an edge thereof close to the score line.

9. A closure as claimed in claim 1, wherein:

a vertical fold is formed in the material of the tear tab along a peripheral edge thereof adjacent the score line and defining at least a downwardly extending bight portion projecting below the plane of the container end wall to form a shield protecting a user from the severed edge of the tear tab when it is separated from the end wall along the score line, said tear tab and container end wall defining substantially smooth, planar surfaces free of recesses which might trap foreign matter.

10. A closure as claimed in claim 9, wherein:

a rigidifying rib is formed in the material of the tear tab, spaced inwardly from an outer peripheral edge thereof.

* * * * *